US006301721B1

(12) United States Patent
Arai

(10) Patent No.: US 6,301,721 B1
(45) Date of Patent: Oct. 16, 2001

(54) SHIELD FIXING STRUCTURE IN HELMET

(76) Inventor: Michio Arai, c/o Arai Helmet, Ltd., 12 Azuma-cho 2-chome, Ohmiya-shi, Saitama-ken (JP)

( * ) Notice: Subject to any disclaimer, the term of this patent is extended or adjusted under 35 U.S.C. 154(b) by 0 days.

(21) Appl. No.: 09/266,903

(22) Filed: Mar. 12, 1999

(51) Int. Cl.[7] ..... A42B 3/22
(52) U.S. Cl. ..... 2/424
(58) Field of Search ..... 2/410, 411, 424, 2/15, 10

(56) References Cited

U.S. PATENT DOCUMENTS 4,920,585 * 5/1990 Arai ..... 2/424
5,062,162 * 11/1991 Kamata ..... 2/424
5,165,117 * 11/1992 Kamata ..... 2/424
5,177,817 * 1/1993 Kamata ..... 2/424
5,182,816 * 2/1993 Arai ..... 2/424
5,185,889 * 2/1993 Kamata ..... 2/424
5,461,731 * 10/1995 Shida ..... 2/424

FOREIGN PATENT DOCUMENTS 0461533 12/1991 (EP) .
0498099 8/1992 (EP) .
434004 2/1992 (JP) .
689483 11/1994 (JP) .

* cited by examiner

*Primary Examiner*—Michael A. Neas
(74) *Attorney, Agent, or Firm*—Dykema Gossett PLLC

(57) ABSTRACT

The object of the invention is to improve an easiness in removing operation of a shield. The operating lever is rotated or slid to push wide the shield pressing cover in an outward direction, a clearance through which the shield can pass is formed between the shield pressing cover and the top point of the supporting shaft, the fixing section of the shield is reached to the top point of the supporting shaft, thereby the shield can be easily removed.

3 Claims, 15 Drawing Sheets

SHIELD FIXING STRUCTURE IN HELMET

BACKGROUND OF THE INVENTION

1. Field of the Invention

This invention relates to a shield fixing structure which is installed in a full-face type helmet and an open face type helmet which a driver wears helmet when he or she rides on various kinds of motorized vehicles such as motorcycle, automobile or others.

2. Description of the Prior Art

As Japanese Patent Publication No. Hei 6-89483, the present applicant has filed as a proposal a fixing structure in which a shield can be fixed or disengaged without removing the shield pressing cover. Under this invention, all the disadvantages that the shield could not be fixed or disengaged unless the shield pressing cover was removed, i.e. disadvantages that the screws for use in fixing the shield pressing cover are lost or the engaging members formed at the shield pressing covers are damaged have been resolved.

However, the fixing structure in the aforesaid invention is operated such that after the shield is rotated up to its upper limit position, the portion near the shield fixing section is held by a hand, it is moved in such a direction as one exceeding the upper limit position while the fixing section is being lifted up in such a direction as one moving away from an outer surface of the base plate, the shield stopper section is disengaged and subsequently as the shield is pulled out toward an opening section, resulting in that the shield fixing section is guided by a slant surface of a guiding protrusion at the base plate and concurrently the fixing hole at the fixing section is disengaged from the supporting shaft, reaches the top point of the supporting shaft, thereby the shield pressing cover is pushed wide in an outward direction, a clearance through which the shield can pass is formed between the cover and the top point of the supporting shaft and then the shield can be easily removed under utilization of this clearance. That is, an operation differing from a normal opening or closing operation is applied to the shield by a hand of the user against the shield to remove the shield.

However, in the case that the aforesaid operation is performed by a hand of a user and the user is not familiar with a removing operation, there occurs sometimes that the shield can not be removed smoothly in accordance with a degree of applied force and so it is strongly requested to make a further smoothness in this removing operation.

SUMMARY OF THE INVENTION

It is an object of the present invention to provide a fixing structure in which a further smoothness in removing operation for the aforesaid shield can be attained and the shield can be removed easily and rapidly by everybody without being dependent on the user.

In order to accomplish the aforesaid object, the present invention has employed the following technical means.

A force directed in a direction moving away from a main body of the helmet differing from a normal opening or closing operation of the shield in respect to the shield is applied near fixing portions of the shield at a predetermined position under a state in which resilient shield pressing covers are engaged with a shield rotatably pivoted around supporting shafts of base plates fixed to right and left side surfaces of a main body of the helmet, the main body of the helmet or the base plates, the shield is removed from the supporting shafts of the base plates, the shield pressing covers are pushed wide in an outward direction to form a clearance between the cover and a top end of the supporting shaft where the shield can pass through it and the shield is engaged with or disengaged from the helmet, operating levers for disengaging the fixing portions of the shield from the main body of the helmet, removing them from the supporting shafts of the base plates and having slant surface sections forming a clearance between the top ends of said supporting shafts and the shield pressing covers and pushing-up surface sections for moving the shield fixing portions in the clearance are rotatably or slidably arranged between the main body of the helmet and the shield pressing covers so as to facilitate a removal of the shield.

As a practical structure of the aforesaid operating levers to be rotated, for example, there may be provided the structure in which its extremity end has the operating section projected from the opening and its rear end has a supporting section pivotally supported at the base plate and an assembly in which a slant surface section for generating a force applied in a direction repelling from the main body of the helmet and a pushing-up surface section for moving the fixing section to the aforesaid clearance are co-operatively arranged at the shield fixing section is installed near the supporting section.

In the case of this operating lever, as its operating section is rotated in the same direction as an opening direction of the shield, the slant surface section arranged at the supporting section enters between the base plate and the shield fixing section so as to cause the fixing section to be moved away from the base plate along an axial line of the supporting shaft. Then, the fixing section is moved away from the supporting shaft to cause the shield pressing cover to be pushed wide in an outward direction. Then, a clearance through which the fixing section can pass is formed between the pushed and widened shield pressing cover and the supporting shaft. Further, as the operating section is operated, the pushing-up surface section pushes up the aforesaid fixing section into the clearance and causes it to reach the top point of the supporting shaft.

In addition, as a practical configuration of the aforesaid operating lever which is slid, for example, there may be employed an assembly of an operating lever in which a sliding section having an operating section projected from an opening at its extremity end, a slant surface section for generating a force acted in a direction repelling from the main body of the helmet near the shield fixing section at its rear end and a pushing-up surface section for moving the fixing section in the aforesaid clearance can be slid and arranged in such away that a biasing force is acted in such a direction as one in which the sliding section is moved away from the shield fixing section.

In the case of this operating lever, as the sliding section is slid, the slant surface section arranged at the sliding section enters between the base plate and the shield to cause the fixing section to be repelled from the base plate along the axial line of the supporting shaft. Then, the fixing section is removed from the supporting shaft to cause the shield pressing cover to be pushed wide in an outward direction. Thus, a clearance through which the fixing section may pass is formed between the pushed and widened shield pressing cover and the supporting shaft. In addition, as the operating section is slid, the pushing-up surface section pushes up the aforesaid fixing section into the clearance and causes it to reach the top point of the supporting shaft.

The aforesaid operating lever is arranged in such a way that it may be projected out of or entered into the opening formed by the base plate and the shield pressing cover and the operating lever may be projected by a projecting mechanism arranged to cause the operating lever to be projected out of the aforesaid opening as the shield is opened in respect to the operating lever.

As a practical configuration of the aforesaid operating lever, it is possible to arrange an assembly which is provided over the operating lever and the shield, for example, and the assembly is comprised of a pushing piece arranged in the shield and a pushing section arranged near the aforesaid supporting section, pushed by the aforesaid pushing piece to cause the aforesaid operating section to be projected out of the aforesaid opening as the shield is opened from a location near the predetermined position to the predetermined position.

In the case of this projecting-out mechanism, as the shield is opened, the pushing section is pushed with the opening shield and along with this operation, the supporting section is rotated and the operating section is projected out of the opening.

In addition, it is possible to provide a system having a biasing means arranged between the aforesaid supporting section and the base plate in such a way that the aforesaid projecting-out mechanism is arranged over the operating lever and the base plate and a biasing force for always rotating the shield toward the aforesaid opening in respect to the supporting section is acted.

In the case of the projecting-out mechanism, as the shield is opened, the operating lever which has been pressed by the shield is rotated by a biasing force to cause the operating section to be projected out of the opening.

BRIEF DESCRIPTION OF THE DRAWINGS

FIG. 4(*b*) is a sectional view taken along line (b)–(b') of FIG. 3.

DESCRIPTION OF THE PREFERRED EMBODIMENT(S)

Figure 1:
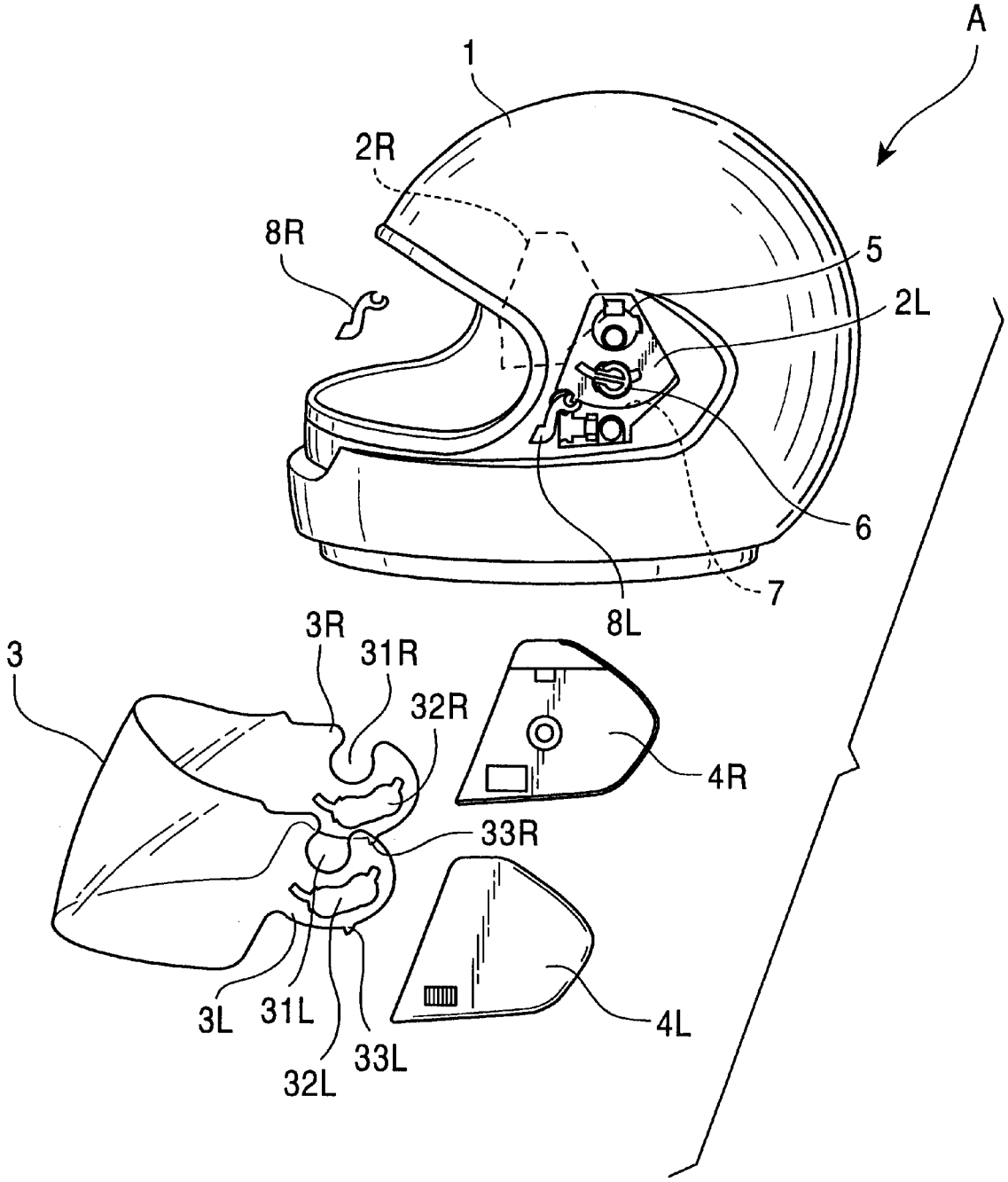
FIG. 1 is an exploded perspective view for showing a full-face type helmet using a fixing structure of the present invention.

Referring now to the drawings, some preferred embodiments of the present invention will be described as follows, wherein FIG. 1 shows a full-face helmet A to which the fixing structure of the present invention is applied and it shows an example in which operating levers 8L, 8R of rotating operation type are provided. In this figure, 1 denotes a main body of the helmet, 2L, 2R denote base plates fixed to the right and left outer surfaces of the main body 1 of the helmet, 3 denotes a shield, and 4L, 4R denote shield pressing covers. Since the operating levers 8L, 8R, the base plates 2L, 2R and the shield pressing covers 4L, 4R have the same form at their right and left sections, only the operating lever 8L, base plate 2L, shield pressing cover 4L and their associated portions will be described later.

The base plate 2L has a supporting shaft 5 acting as a rotating center of the shield 3, a resilient engaging piece 6 for restricting a rotating range of the shield 3 and applying a certain limitation to its opening motion, a guiding concave section 7 to which a shield stopper section 33L arranged at a lower end circumferential edge of the shield 3 is fitted and for guiding a rotation of the shield 3 from its full-closed state to a state approximate to its full-opened state, and an operating lever 8L to cause the shield 3 to perform an operation differing from the normal opening or closing operation.

The operating lever 8L is operated to cause the fixing section (mounting portion) 3L of the shield 3 to generate a force in a direction repelling from the main body of the helmet through its rotating operation.

As to the shield 3 and the shield pressing cover 4L, their configurations are substantially similar to that of the prior art, so that their detailed description will not be provided. The shield 3 is formed into a predetermined shape with either a transparent or colored and resilient synthetic resin plate. The fixing section 3L is formed with a fixing hole 31L fitted to the supporting shaft 5, a guiding hole (slot) 32L fitted to the resilient engaging piece 6 to restrict a rotating range of the shield 3 and a shield stopper 33L. Further, description of the illustrated fixing section 3R, fixing hole 31R and guiding hole 32R will be omitted due to the fact that their configurations are similar to those of the fixing hole 31L, the guiding hole 32L and the shield stopper 33L.

Figure 2:
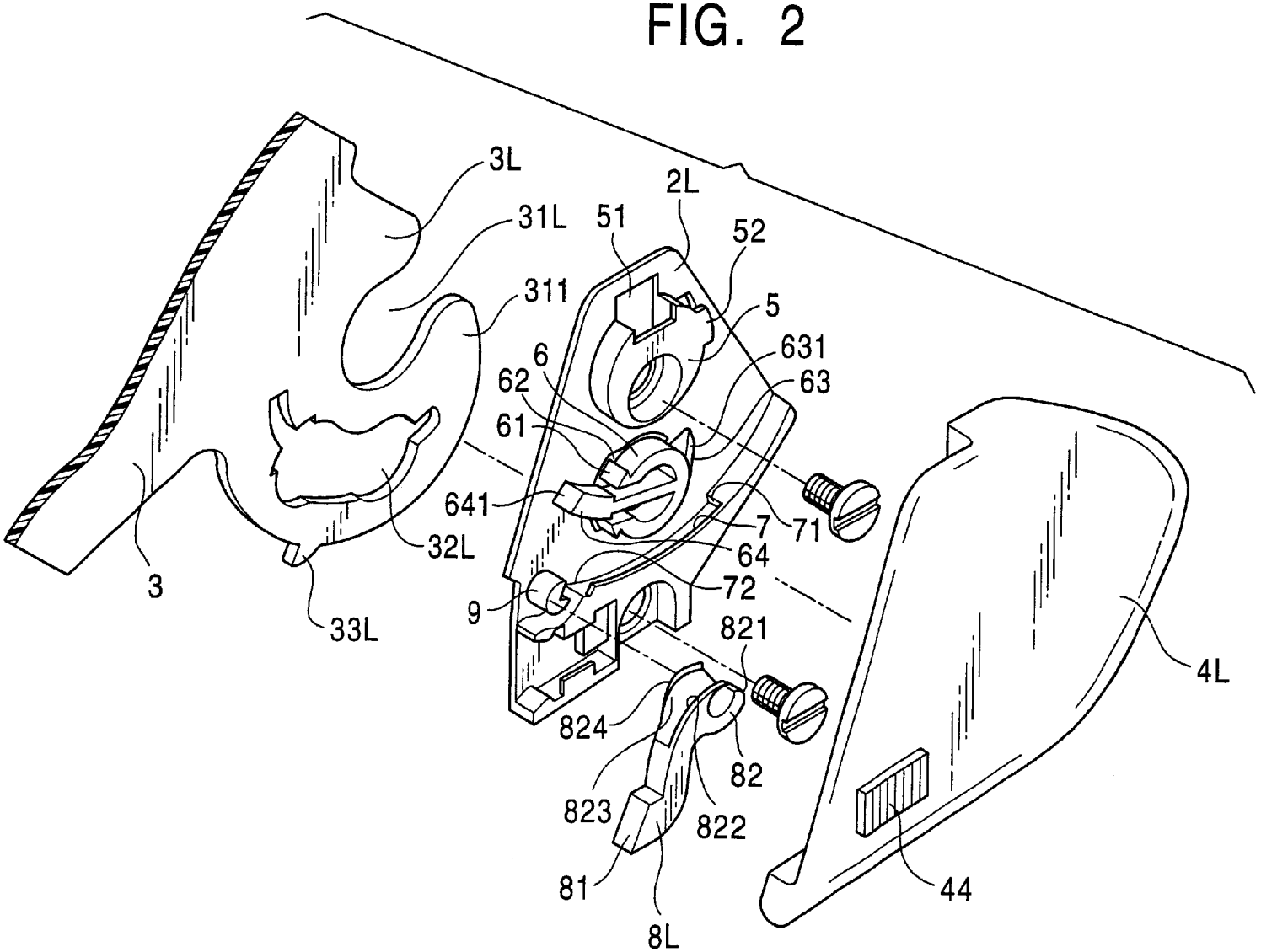
FIG. 2 is an exploded perspective view for showing a substantial part in its enlarged state.
Figure 3:
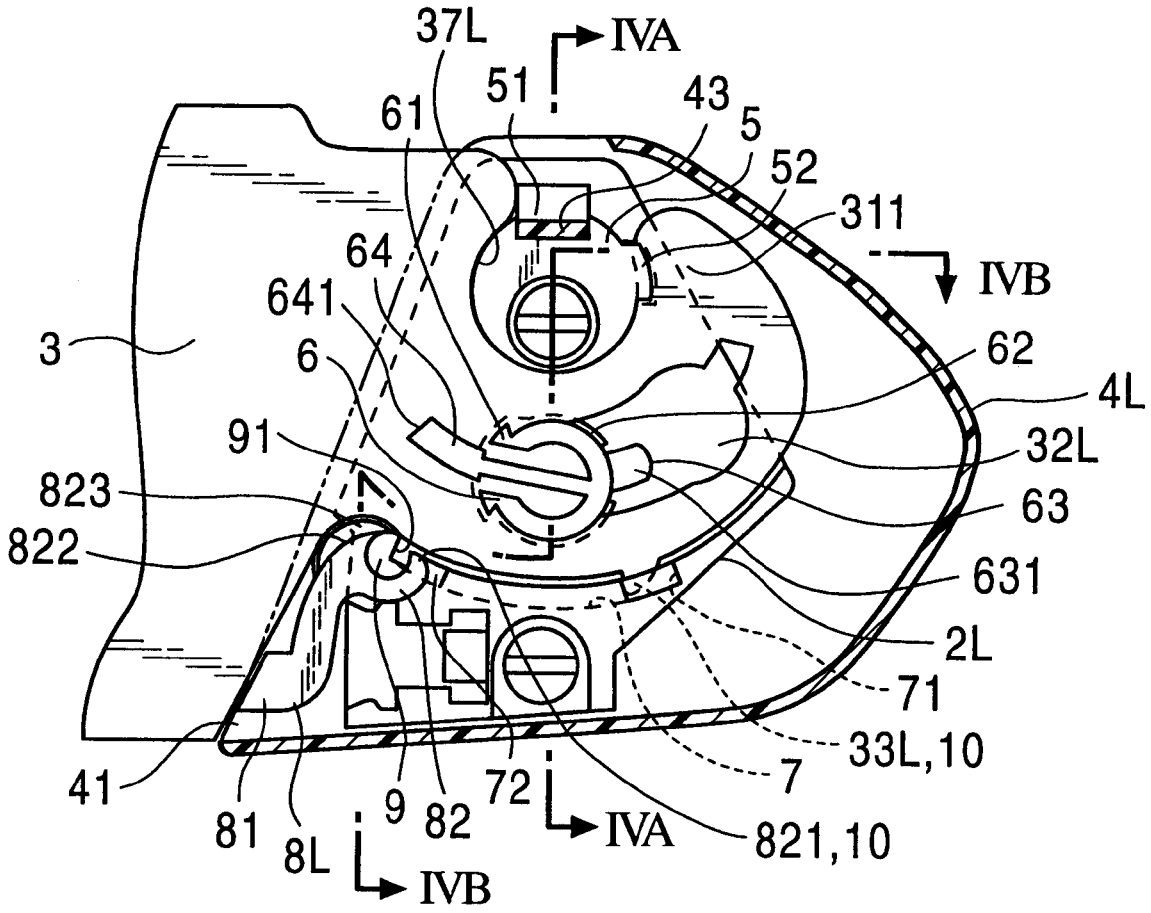
FIG. 3 is a side elevational view for showing a substantial part with a part being broken away to illustrate a shield fixing state.
Figure 4A:
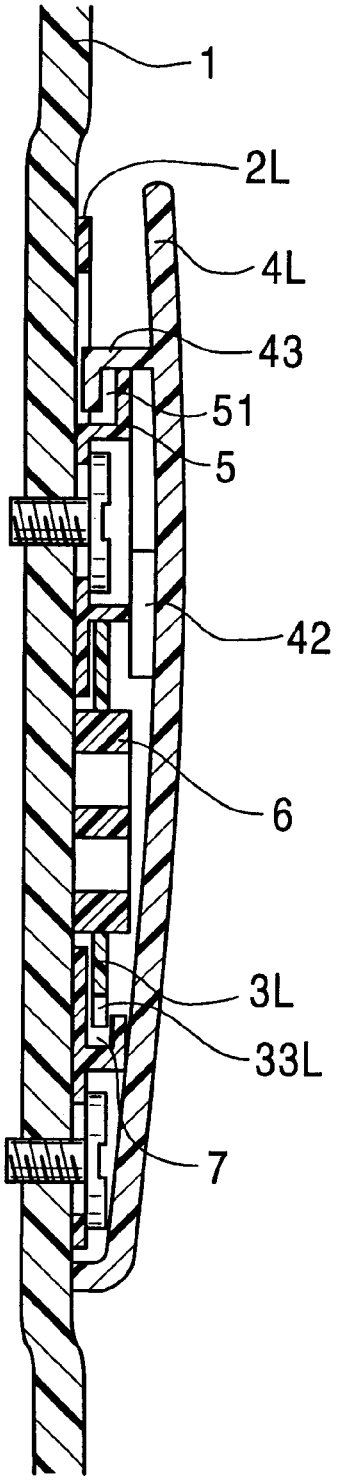
FIG. 4(*a*) is a sectional view taken along line (a)–(a') of FIG. 3.
Figure 4B:
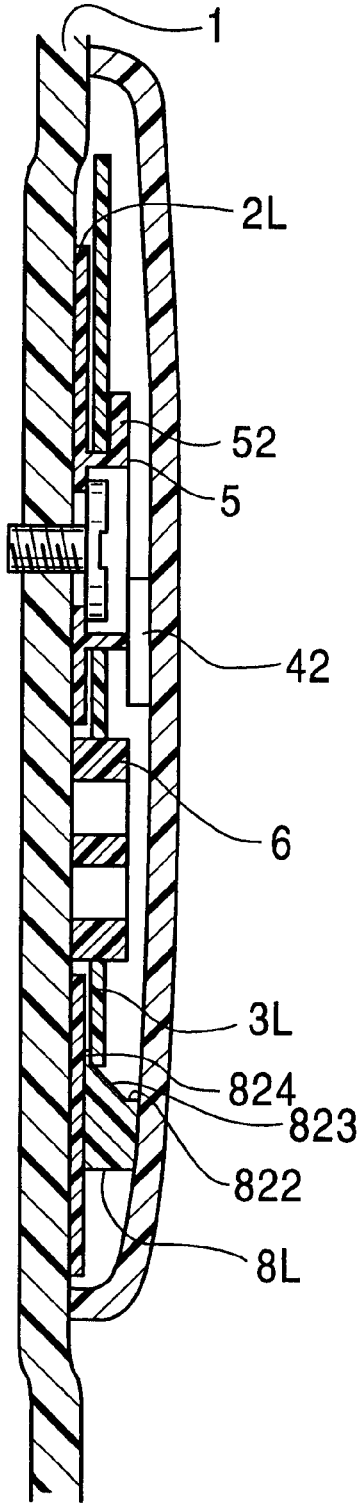

The shield pressing cover 4L is formed of resilient synthetic resin material to cover the base plate 2L, and an opening 41 (see FIG. 5) through which the shield 3 is pulled out or inserted is formed at its front side between it and the main body 1 of the helmet. In addition, reference numeral 42 (see FIG. 4*a*) denotes a protrusion to press the fixing section 3L against the base plate 2L, reference numeral 43 denotes an engaging protrusion engaged with a concave part 51 arranged in the supporting shaft 5 in the base plate 2L, reference numeral 44 (see FIG. 2) denotes a lock section for fixing the shield pressing cover 4L to the base plate 2L, wherein the lock section 44 is arranged over both of them, its locked state is released under an operation performed from an external side, thereby the shield pressing cover 4L is removed from it.

The extremity end edge projected in a circular shape as seen in its front elevational view of the supporting shaft 5 is formed with a holding piece 52 for holding the shield 3 against its pulling-out when the shield 3 is rotated from its full-closed state to a state approximate to its full-opened state, and under a state other than the full-opened state of the shield 3, it holds the end surface 311 of the fixing hole 31L with the base plate to prevent it from being pulled out of it and when the shield 3 becomes the full-opened state, its anti-pulling state is released to enable the shield 3 to be pulled out or inserted into it.

The resilient engaging piece 6 is formed into a substantial C-shape as seen in its front elevational view with a part of the circular ring being cut way, a part of the closed outer circumferential surface is connected to the base plate 2L and both opened side ends are provided with claw sections 61, 62 directed toward an outer side in a diameter direction. In addition, the resilient engaging piece 6 is provided with projected guiding protrusions 63, 64 from the closed side toward the opened side and from the closed side to an outward side, longitudinal side surfaces of these guiding protrusions 63, 64 are formed with slant surfaces 631, 641 inclined toward the base plate 2L so as to enable engaging or disengaging of the shield 3 described later to be smoothly carried out.

The guiding concave section 7 is formed to be an arcuate shape extending along a moving lotus of the shield stopper section 33L during a turning operation of the shield 3 around the supporting shaft 5. The rear side in its longitudinal direction is formed a step section 71 for determining the full-closed state by contacting with the shield stopper section 33L at the full-closed position of the shield 3' and its front side of the longitudinal direction is formed with the releasing section 72. The shield stopper section 33L is released from the guiding concave section 7 through this releasing section 72 at a full-opened state of the shield 3, the shield stopper section 33L to be described later is fitted into the guiding concave part 7 when the fixing to be described later is carried out.

The operating lever 8L has an operating section 81 at its one end and a supporting section 82 pivotally supported at the base plate 2L at the other end, respectively, and the operating lever 8L is rotatably supported at a projected and formed shaft section 9 with a larger clearance than the width of the shield stopper 33L being kept in respect to the end part of the releasing section 72 of the guiding concave section 7. This shaft section 9 is formed with a guiding section 91 recessed axially, to which the shield stopper section 33L is contacted under the full-opened state of the shield 3 so as to determine its full-opened position and guide the shield stopper section 33L in an axial direction.

The operating section 81 is formed with a side edge of the operating lever 8L being projected toward an opening 41.

The supporting section 82 is formed in a substantial C-shape as seen in a front elevational view with a part opposite to the aforesaid opening of a circular ring being cut away.

There is provided a projecting-out mechanism 10 for projecting out the operating lever from the aforesaid opening over this supporting section 82 and the shield 3 as the shield 3 is opened. This projecting-out mechanism 10 will be described in detail, wherein this is comprised of the aforesaid shield stopper section 33L and an one side end edge 821 (a lower side as viewed in the figure) at the C-shaped supporting section 82, the shield stopper section 33L is contacted with the end edge 821 during a motion of the shield stopper section 33L from a location near the full-opened position of the shield 3 to its full-opened position and pushes the aforesaid end edge to cause the supporting section 82 to be rotated in the same direction as the opening direction of the shield 3. That is, the aforesaid operating section 81 is projected out of the opening 41 through rotation of the supporting section 82. In the following description, the end edge 821 will be described as a pushing section and this pushing section is denoted by reference number 821.

In addition, a plane of right angle directed from a plane of the supporting section 82 toward the base plate 2L is formed at a range from an end edge of opposite side of the aforesaid pushing section 821 to a midway part of the operating lever 8L along its circumferential direction and the aforesaid plane is applied as a pushing-up surface section 822 for use in pushing up the fixing section 3L of the shield 3 when the operating lever 8L to be described later is turned. In addition, a slant surface section 823 is formed from a lower end of the pushing-up surface section 822 toward the base plate 2L, the slant surface section 823 enters between the base plate 2L and the fixing section 3L, and the fixing section 3L is lifted up in such a direction as one repelling from the base plate 2L. Further, there is formed a horizontal surface section 824 positioned from the lower end of the slant surface section 823 and between the base plate 2L and the fixing section 3L. Under a state in which the shield 3 is fixed, the horizontal surface section 824 is always positioned between the base plate 2L and the fixing section 3L so as to facilitate an insertion of the aforesaid slant surface section 823 between the base plate 2L and the fixing section 3L.

Referring to FIGS. 5 to 12, engagement or disengagement of the shield 3 of the fixing structure constructed as above will be described. At first, its removing method will be described.

Figure 5:
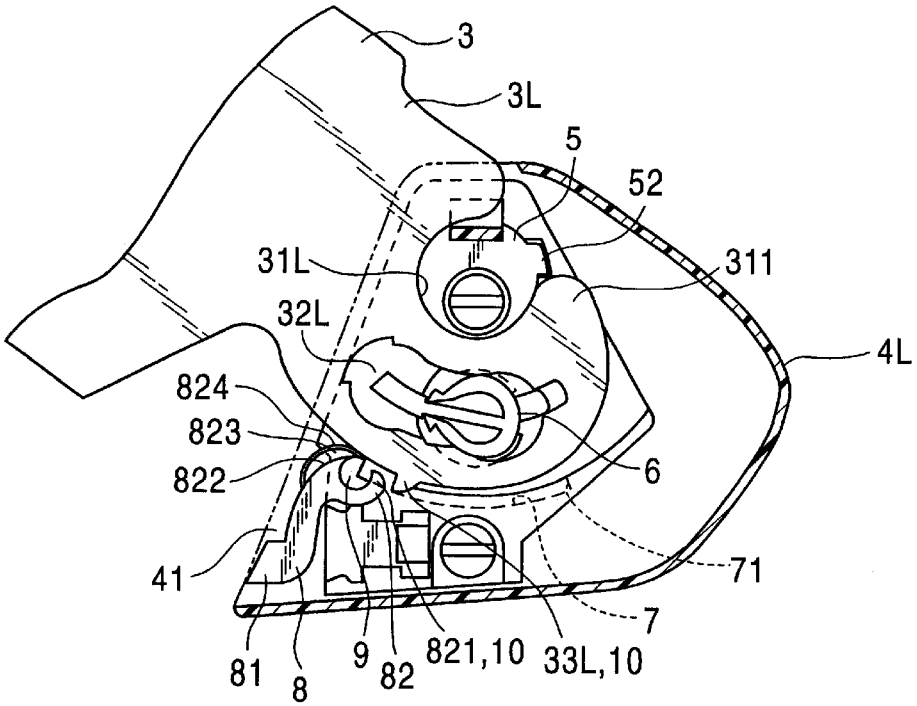
FIG. 5 is a side elevational view for showing a first stage of an order of removing operation with a part being broken away.

At first, as shown in FIG. 5, the shield 3 is opened in an opening direction. At this time, as the shield 3 is rotated, the shield stopper section 33L advances forward, comes out of the releasing section 72 of the guiding concave part 7 and then contacts pushing section 821 at the operating lever 8L.

Figure 6:
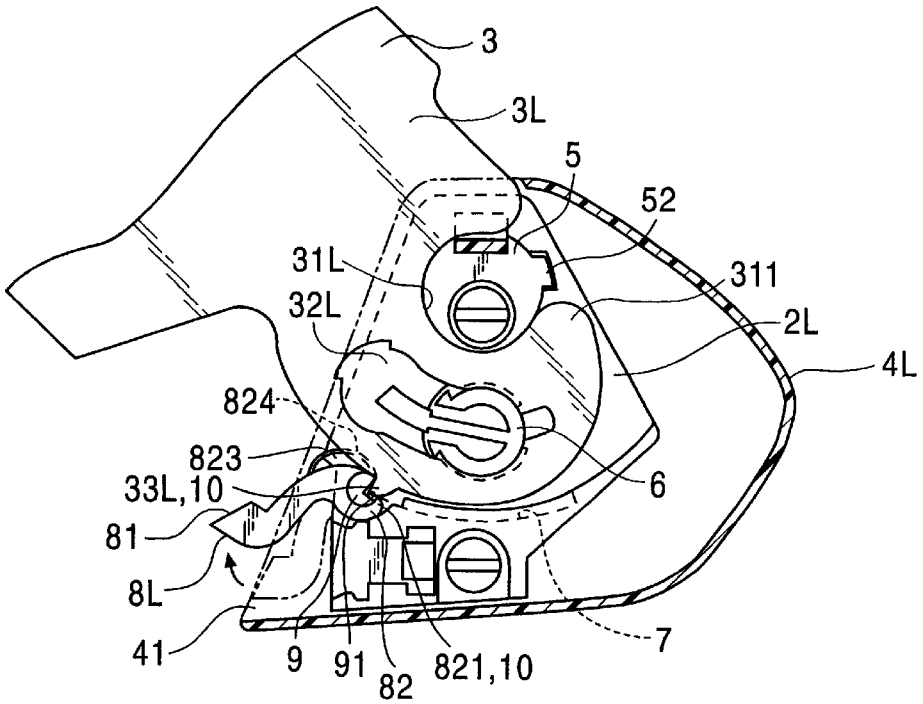
FIG. 6 is a side elevational view for showing a second stage of an order of removing operation with a part being broken away.

As shown in FIG. 6, as the shield is opened to its full-opened state, the stopper section 33L enters into the guiding section 91 and at the same time pushes the pushing section 821 in the operating lever 8L, thereby the supporting section 82 is turned to cause the operating section 81 to be projected out of the opening 41. Further, concurrently with the projection of the operating section 81, the stopping against pulling-out of the fixing section 3L stopped at the supporting shaft by the holding piece 52 is released and then it can be pulled out or inserted into the supporting shaft 5.

Figure 7:
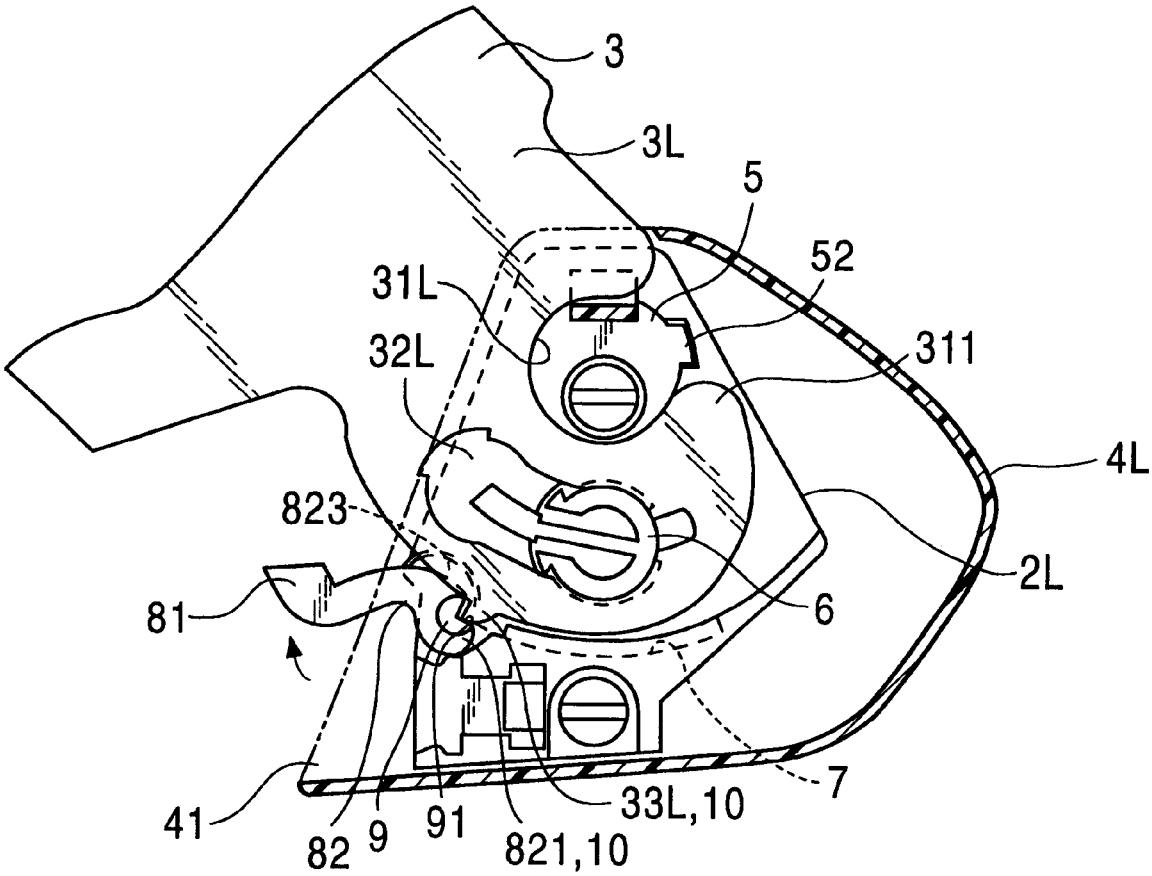
FIG. 7 is a side elevational view for showing a third stage of an order of removing operation with a part being broken away.
Figure 8:
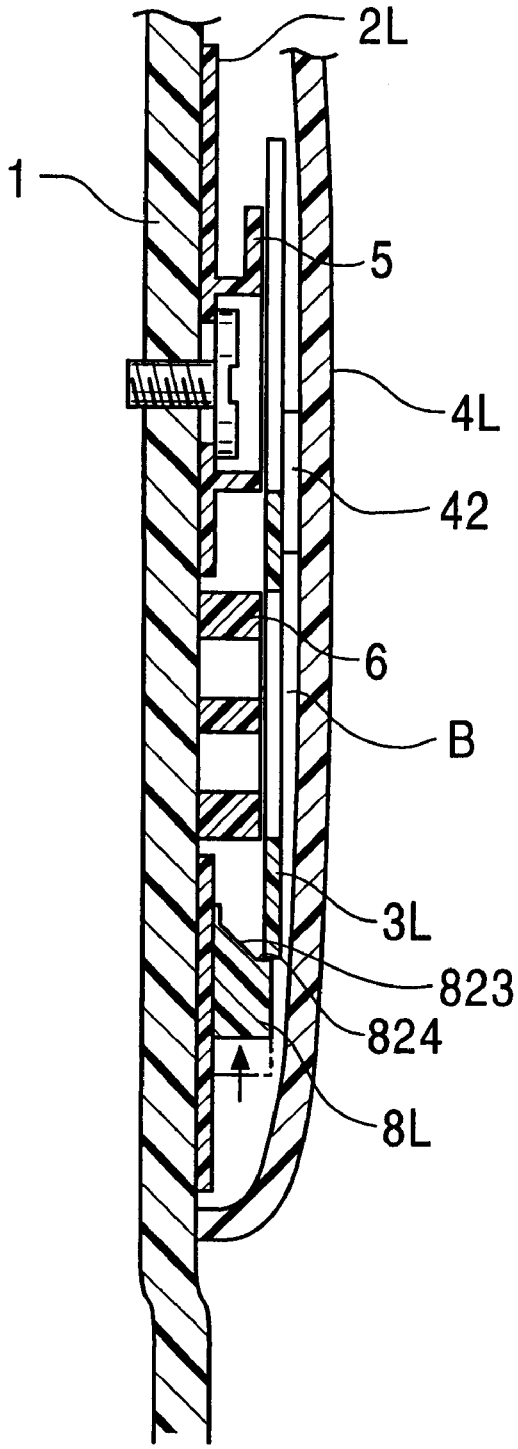
FIG. 8 is a sectional view for showing an operation of the shield at the third stage.

Then, as shown in FIGS. 7 and 8, the projected operating section 81 is turned in an upward direction. At this time, the slant surface section 823 enters between the base plate 2L and the fixing section 3L to guide the fixing part 3L along the slant surface section 823 so as to be widened in an outward direction and at the same time causes the edge of the fixing section 3L to be contacted with the pushing-up surface section 824. Then, the fixing section 3L is removed from the supporting shaft 5 and the resilient engaging piece 6 and concurrently pushes wide the shield pressing cover 4L in an outward direction through a protrusion 42 to form a clearance B through which the fixing section 3L can pass between the cover and the supporting shaft 5.

Figure 9:
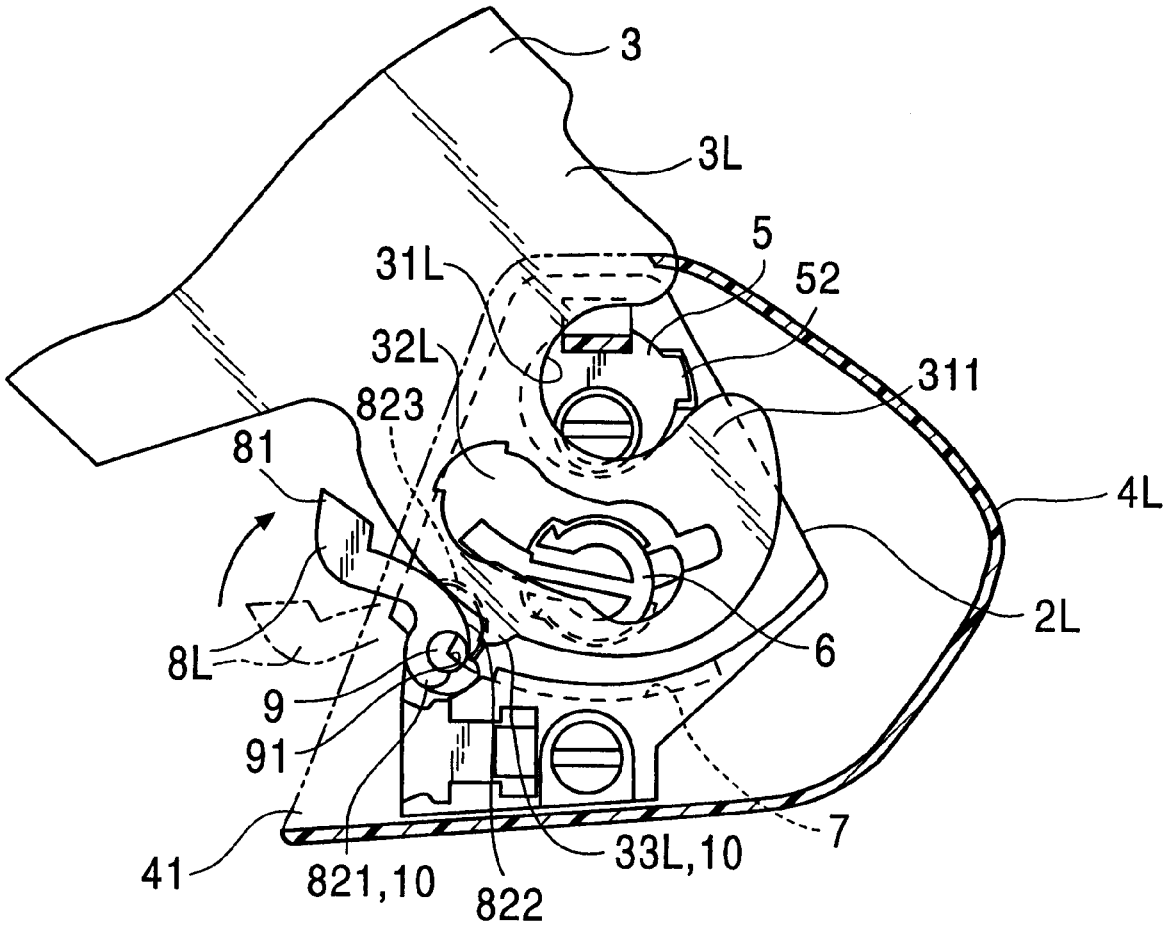
FIG. 9 is a side elevational view for showing a fourth stage of an order of removing operation with a part being broken away.
Figure 10:
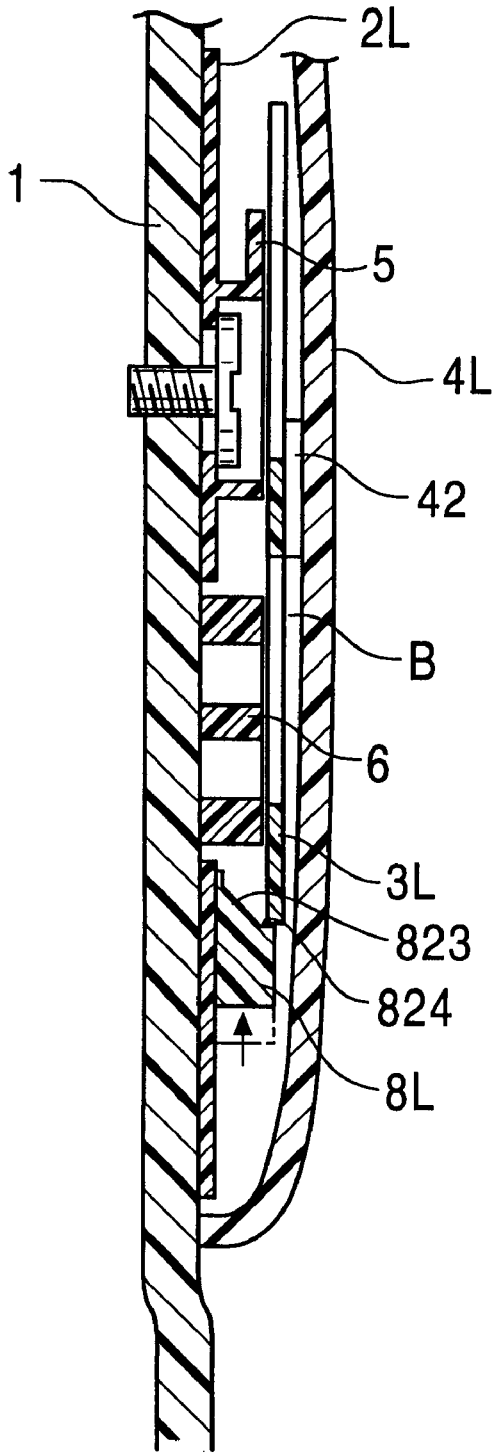
FIG. 10 is a sectional view for showing an operation of the shield at the fourth stage.
Figure 11:
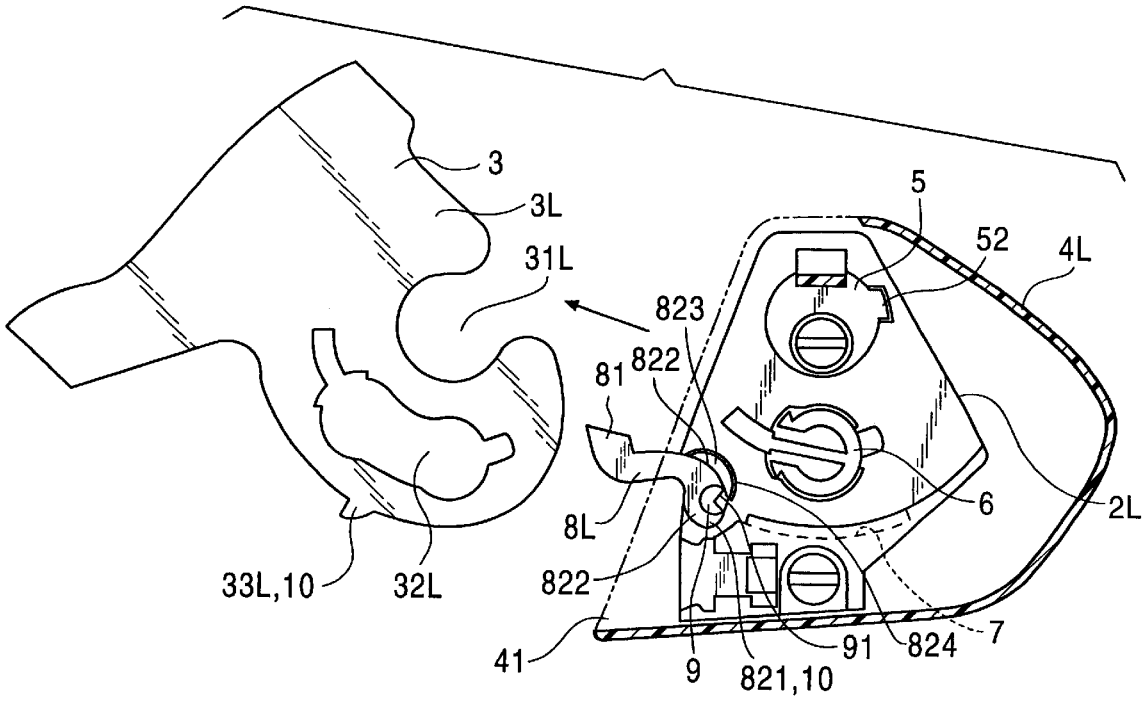
FIG. 11 is a side elevational view for showing a fifth stage of an order of removing operation with a part being broken away.

Subsequently, as shown in FIGS. 9 and 10, as the operating section 81 is further rotated in an upward direction, the pushing-up surface section 824 pushes up the fixing section 3L and enters into the clearance B. With such an arrangement as above, the shield 3 becomes a state in which it can be pulled out and then the shield 3 is pulled out from this state and the shield 3 is removed as shown in FIG. 11.

A method for fixing the shield 3 will be described as follows. This fixing method is carried out such that the fixing section 3L performs basically an operation opposite to that performed when the aforesaid fixing operation is carried out. That is, as the fixing section 3L is inserted at the opening 41, its edge is contacted with the slant surface 641 and it is widened in an outward direction by the slant surface 641. Then, the fixing section 3L pushes wide the shield pressing cover 4L in an outward direction so as to form a clearance through which the fixing section 3L can pass between the cover and the supporting shaft 5 (not illustrated up to this paragraph).

Figure 12:
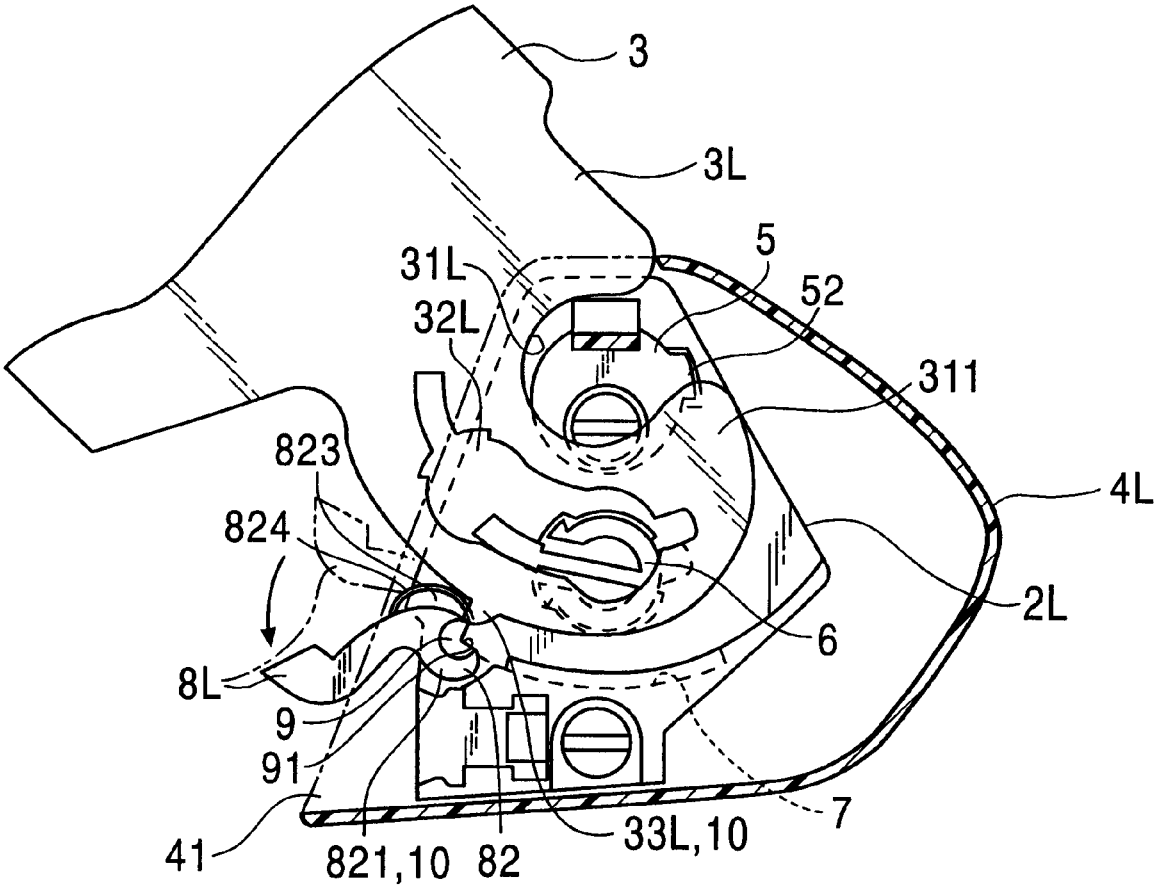
FIG. 12 is a side elevational view with a part being broken away for showing an intermediate state during fixing operation.

As the fixing section 3L is pushed into the clearance from this state, the fixing section 3L rides over the top point of the supporting shaft as shown in FIG. 12 and further as the fixing section 3L is pushed into the clearance, the supporting shaft 5 is fitted to the fixing hole 31L, the resilient engaging piece 6 is fitted to the guiding hole 32L and the shield stopper section 33L is fitted to the releasing section 72, respectively, resulting in that the shield 3 becomes its set state (a state similar to that shown in FIG. 6).

Then, an example of the fixing structure in which a slide type operating lever 8L' is arranged will be described. Description about the portions overlapping with those of the fixing structure provided with a repelling device having the aforesaid turning type operating lever will be eliminated.

The operating lever 8L' is operated to generate a force directed to repel from the main body of the helmet at the fixing section 3L' of the shield 3' under its sliding operation.

Figure 13:
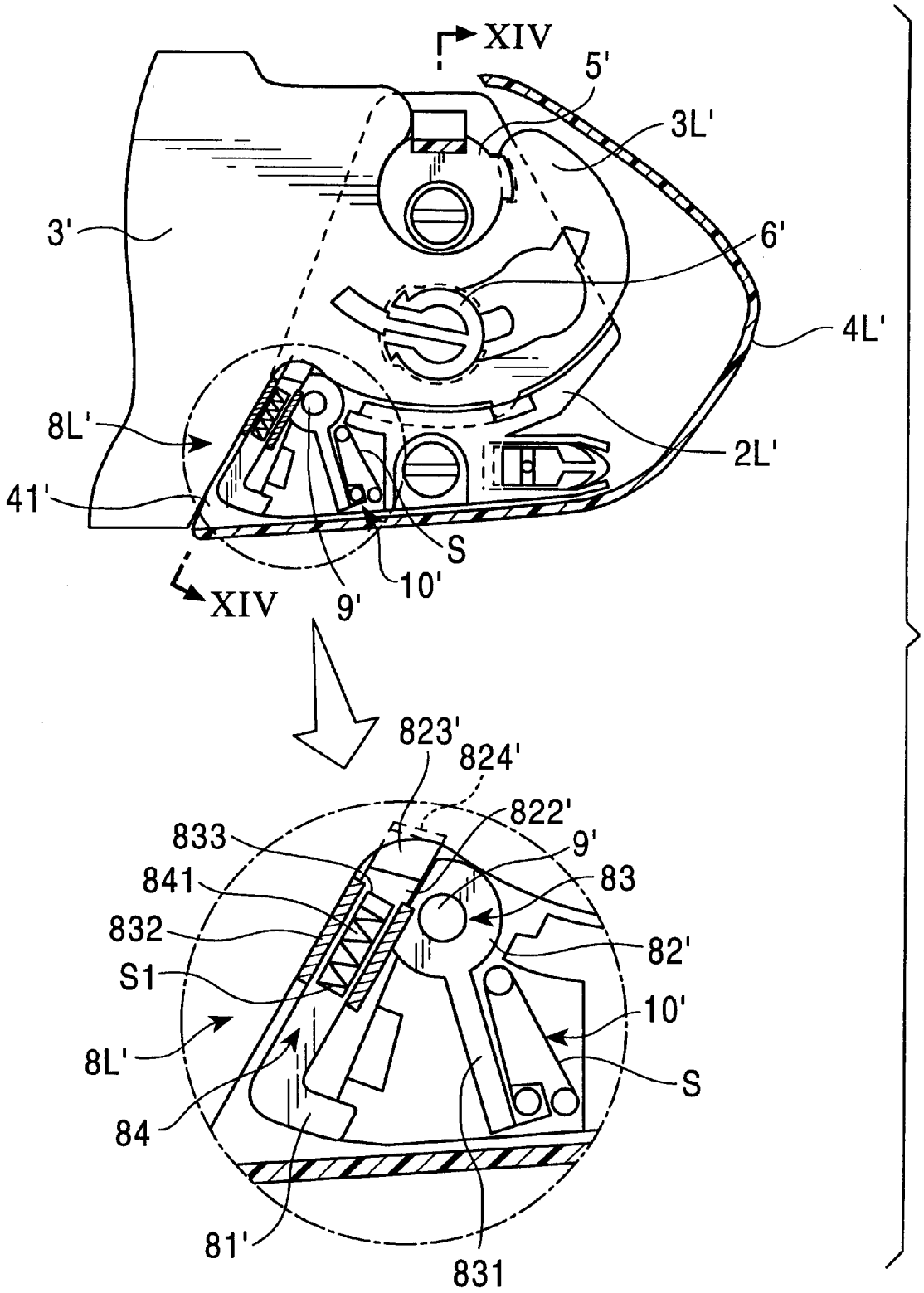
FIG. 13 is an enlarged side elevational view with a part being broken away to show a substantial part of the fixing structure using an operating lever of another example.
Figure 14:
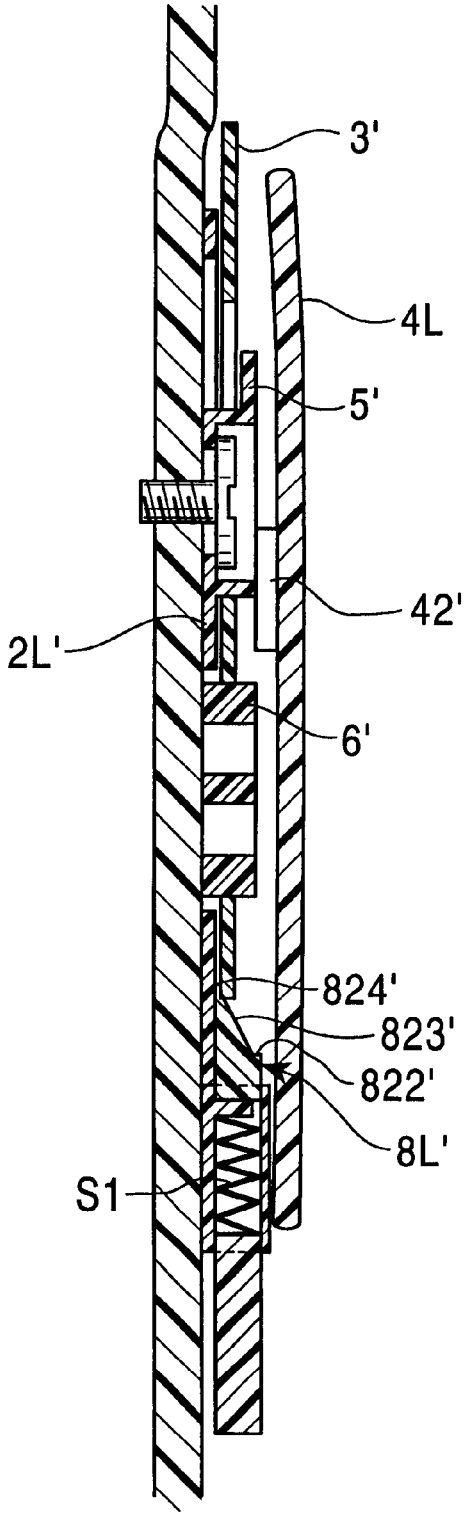
FIG. 14 is a sectional view taken along line (c)–(c') of FIG. 13.

As shown in FIGS. 13 and 14, the operating lever 8L' is rotatably pivoted at a shaft section 9' projected at the base plate 2L', pushed by the shield 3' under the full-closed state of the shield 3' and stored between the base plate 2L' and the shield pressing cover 4L'.

The operating lever 8L' will be described in detail, wherein this operating lever 8L' is comprised of a turning section 83 supported at the shaft section 9' and a sliding section 84 slidably passed through and fixed to the turning section 83.

At the turning section 83, a pushing plate 831 is extended from a supporting section 82' supported at the shaft section 9'. A projecting-out mechanism 10' comprised of a spring S is arranged over the pushing plate 831 and the base plate 2L' and then the turning section 83 is always biased in the same direction as an opening direction of the shield 3' by a biasing force of the spring S.

The sliding section 84 has an operating section 81' at its extremity end and a pushing-up surface section 822', a slant surface section 823' and a horizontal surface 824' at its rear end, respectively, and the sliding section is slidably fitted to the fitting section 832 which is integrally formed with the aforesaid turning section 83. In addition, the sliding section 84 at its light rear end has a rectangular-shaped through-pass hole 841 opened thereat. A protrusion 833 projected at the fitting section 832 is fitted to the through-pass hole 841 and a compression spring S1 is arranged between the protrusion 833 and the through-pass hole 841, thereby the sliding section 84 is always biased to move away from the shield 3'.

The aforesaid pushing-up surface section 822', slant surface section 823' and horizontal surface 824' produce the similar action to that of the aforesaid example, wherein the pushing-up surface section 822' is comprised of a surface at a right angle directing from the surface of the sliding section 84 toward the base plate 2L'. In addition, the slant surface section 823' is comprised of a slant surface facing from the lower end of the pushing-up surface section 822' toward the base plate 2L'. The horizontal surface 824' is projected from the lower end of the slant surface section 823' in a plane surface shape along the surface of the base plate 2L'.

Figure 15:
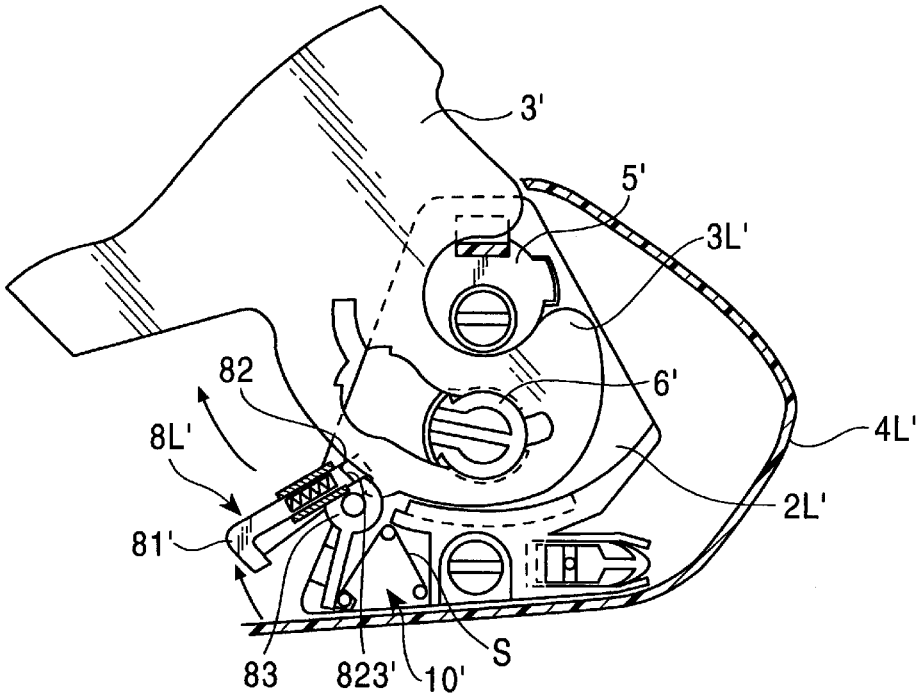
FIG. 15 is a side elevational view with a part being broken away for showing a first stage of an order of removing operation.
Figure 17:
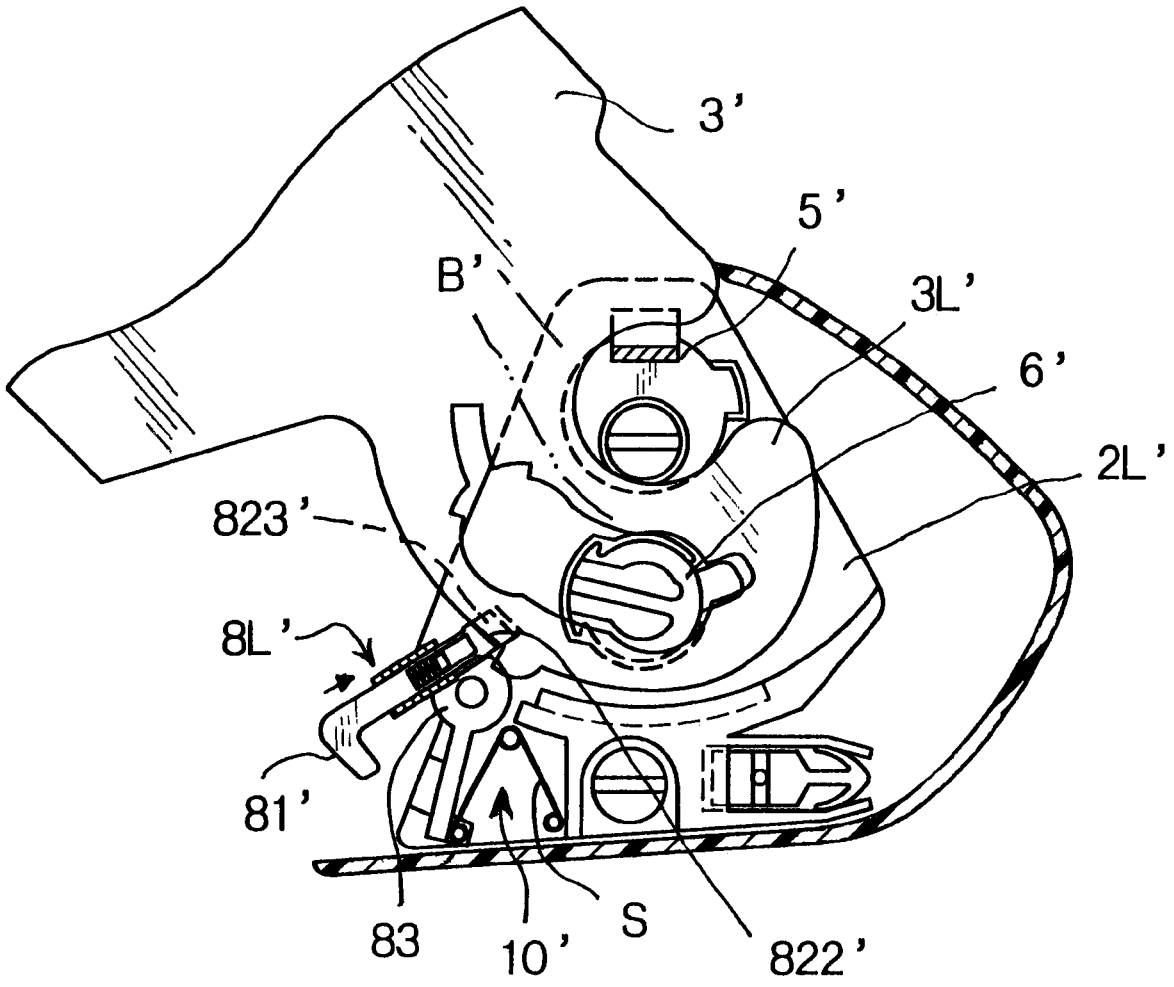
FIG. 17 is a side elevational view with a part being broken away for showing a third stage of an order of removing operation.

Referring to FIGS. 15 and 17, removal of the shield 3' at such a fixing structure as described above will be described.

At first, as shown in FIG. 15, when the shield 3' is opened, the turning section 83 is rotated by a biasing force of the projecting-out mechanism 10', i.e. the spring S and then the operating section 81' is projected out of the opening 41'.

Figure 16:
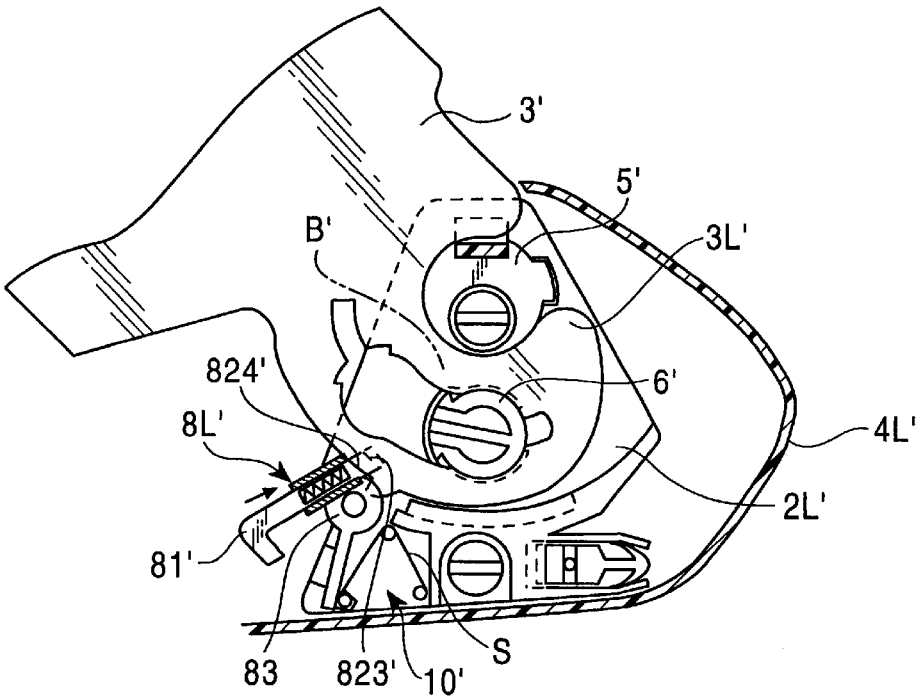
FIG. 16 is a side elevational view with a part being broken away for showing a second stage of an order of removing operation.

Then, as shown in FIG. 16, after the shield 3' is set to full-opened state, the operating section 81' is pushed up against the biasing force of the compression spring S1 to cause the sliding section 84 to be slid. Then, the slant surface section 823' enters between the base plate 2L' and the fixing section 3L' to guide the fixing section 3L' to be widened outwardly along the slant surface section 823' and at the same time to cause the edge of the fixing section 3L' to be contacted with the pushing-up surface section 822'. At this time, in concurrent with an operation in which the fixing section 3L' is moved away from the supporting shaft 5' and the resilient engaging piece 6', the shield pressing cover 4L' is pushed wide in an outward direction through the protrusion 42' and a clearance B' through which the fixing section 3L' is formed between the cover and the supporting shaft 5'.

Subsequently, as shown in FIG. 17, as the operating section 81' is further pushed up, the pushing-up surface section 822' pushes up the fixing section 3L' and causes it to be entered into the clearance B'. With such an arrangement as above, the shield 3' becomes a state in which it can be pulled out. Operating state of the fixing section 3L' or the shield pressing cover 4L' under the state shown in FIGS. 16 and 17 and the form of the clearance B' are similar to those described above in reference to FIGS. 8 and 10, so that their illustration will be eliminated.

Then, the shield can be removed from this state by pulling out the aforesaid shield 3'. Since the removed state is similar to that described in reference to FIG. 11, its illustration will be eliminated.

As to the fixing of the aforesaid shield 3', it is similar to that of the aforesaid example, its illustration will be eliminated. After the shield 3' is set, the shield is set to its full-closed state, resulting in that the operating lever 8L' is pushed by the shield 3' and stored and then the shield returns to the state shown in FIG. 13.

As described above, the fixing structure of the present invention is operated such that the fixing or removing of the shield can be performed quite easily with the shield pressing cover being fixed and in particular it can be performed positively and rapidly under an operation of the operating lever in the repelling device during its removing operation.

In the preferred embodiments of the present invention, the examples of the full-face type helmet have been described, although this fixing structure can be worked also in an open face type helmet.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope of the invention as defined by the appended claims.

What is claimed is:

1. A helmet for use by a vehicle user which comprises:

a helmet shell which defines a left side, a right side and a front end which defines an open face portion, left and right base plates respectively mounted on the left and right sides of said helmet shell, each base plate including a support shaft that extends away from said helmet shell, a curved concave guiding portion below said support shaft, and a shaft section located at a forward end of said curved concave guiding portion, left and right shield pressing covers connected to said respective left and right base plates, a curved face shield having a center portion for covering said open front face portion of said helmet, and opposite left and right mounting portions for positioning between respective left and right base plates and shield pressing covers, each of said left and right mounting portions including a fixing hole for positioning around a support shaft of a respective base plate and a stopper section for movement along a respective curved concave guiding portion, and left and right elongated operating levers for positioning on said shaft sections of respective said left and right base plates, each said elongated operating lever including a C-shaped supporting section at a first end thereof which is positioned around a respective shaft section and which defines an end edge for contact by a stopper section of a respective mounting portion of said face shield, a push-up surface section on a first side thereof nearest the respective pressing cover and extending from said first end toward a second end thereof, and a slant surface section which extends from said push-up surface section toward an opposite second side of said operating lever nearest the respective base plate, said operating levers facilitating disengagement of the face shield relative to the helmet shell by causing disengagement of the respective left and right mounting portions of the face shield relative to the support shafts of the respective base plates and enabling movement of said left and right mounting portions in spaces formed between the respective support shafts and pressing covers.

2. A helmet in accordance with claim 1, wherein each of said left and right operating levers includes a flat surface portion at said second side thereof.

3. A helmet in accordance with claim 1, wherein said left and right base plates include a resilient engaging piece extending away from the helmet shell and each of said left and right mounting portions of said face shield define guide slots for cooperation with respective engaging pieces.

* * * * *